United States Patent [19]

Ikegawa et al.

[11] Patent Number: 4,947,212

[45] Date of Patent: Aug. 7, 1990

[54] DEVELOPING APPARATUS WITH COLOR DEPENDENT TONER SUPPLY VOLTAGE

[75] Inventors: Akihito Ikegawa; Hiroshi Mizuno; Hiroshi Murasaki; Kouichi Etou, all of Osaka, Japan

[73] Assignee: Minolta Camera Kabushiki Kaisha, Osaka, Japan

[21] Appl. No.: 195,155

[22] Filed: May 18, 1988

[30] Foreign Application Priority Data

May 19, 1987 [JP] Japan ..... 62-122850

[51] Int. Cl.[5] ..... G03G 15/06

[52] U.S. Cl. ..... 355/265; 355/253; 355/326

[58] Field of Search ..... 118/645, 656, 657, 658; 355/14 D, 4, 3 DD

[56] References Cited

U.S. PATENT DOCUMENTS

| | | | |
|---|---|---|---|
| 4,213,692 | 7/1980 | Akiyama et al. | 355/14 D |
| 4,508,052 | 4/1985 | Kohyama | 118/658 X |
| 4,671,646 | 6/1987 | Florack et al. | 355/14 D X |
| 4,742,370 | 5/1988 | Murakami et al. | 355/3 DD |

FOREIGN PATENT DOCUMENTS

| | | | |
|---|---|---|---|
| 0158657 | 9/1983 | Japan | 355/4 |
| 59-113463 | 6/1984 | Japan . | |
| 0045252 | 3/1986 | Japan | 355/4 |
| 61-80280 | 4/1986 | Japan . | |
| 62-283369 | 12/1987 | Japan . | |

*Primary Examiner*—A. T. Grimley
*Assistant Examiner*—Robert Beatty
*Attorney, Agent, or Firm*—Burns, Doane, Swecker & Mathis

[57] ABSTRACT

An electrophotographic copying apparatus includes a main body, a developing system, removably mounted on the main body, provided with a developing device having the developing sleeve holding a carrier on the outer surface, and a toner cartridge having a toner supply roller which confronts the developing sleeve. A voltage-adjusting device adjusts the bias voltage to be supplied respectively to the developing sleeve and the toner supply roller depending on a toner color so as to generate a predetermined electric potential between the developing sleeve and the toner supply roller. The voltage adjusting device adjusts the bias voltage difference between the developing sleeve and the toner supply roller according to a saturation charge amount which is different depending on the toner color.

8 Claims, 7 Drawing Sheets

DEVELOPING APPARATUS WITH COLOR DEPENDENT TONER SUPPLY VOLTAGE

BACKGROUND OF THE INVENTION

1. Field of the Invention

The present invention relates to an electrophotographic copying apparatus such as a copying machine, and more particularly, to an electrophotographic apparatus preferable for forming a picture image in a different color having an appropriate density.

2. Description of the Related Art

An electrophotographic copying apparatus provided with a developing device having a developing sleeve, a toner supply roller confronting the developing sleeve, and a toner hopper provided with the toner supply roller has been proposed.

In the conventional electrophotographic copying apparatus, toner particles (i.e., toner) in the toner hopper are supplied to the outer surface of the developing sleeve by the toner supply roller. The toner supplied to the outer surface of the developing sleeve is mixed with carriers held thereon, whereby the toner and the carrier are charged with polarities opposite to each other to form a developer consisting of two components. At this time, the mixing ratio between the toner and carrier is controlled on the basis of the difference of the bias voltage which is applied to the developing sleeve and the toner supply roller. The developer thus formed on the developing sleeve is transported to the gap between the developing sleeve and an electrostatic latent image formed on an image-holding member. Thereafter, the charged toner is electrostatically supplied to the electrostatic latent image to form a toner image.

In this type-electrophotographic copying apparatus, a picture image is developed in a different color by exchanging the developing device for a developing device containing toner particles in the different color.

A picture image can be also developed in a color by collecting toner particles held on the outer surface of the developing sleeve into the toner hopper and exchanging the toner hopper for a toner hopper containing toner particles in the different color by adjusting the bias voltage supplied, respectively, to the developing sleeve and the toner supply roller.

However, a saturation charge amount of toner particles varies with different colors. Therefore, if a picture image is developed with the bias voltage fixed, i.e., if the constant voltage is generated between the toner supply roller and the developing sleeve in developing images in a different color, it is impossible to form the image of an original document in a predetermined density on a copy sheet.

Accordingly, it is necessary in the above-mentioned apparatus to change the bias voltage to an appropriate voltage in accordance with toner particles to be used each time a toner hopper is exchanged.

SUMMARY OF THE INVENTION

Accordingly, an essential object of the present invention is to provide an improved electrophotographic copying apparatus which can overcome such disadvantages as described above. In accomplishing this and other objects according to one preferred embodiment of the present invention, there is provided an improved electrophotographic copying apparatus comprising a main body, a developing means, removably mounted on said main body, provided with a developing device having a developing sleeve which holds carriers on the outer surface thereof and a toner cartridge including a toner supply roller confronting the developing sleeve; and an electric power source means for respectively supplying a predetermined bias voltage to the developing sleeve and the toner supply roller so as to generate predetermined electric potential between said developing sleeve and said toner supply roller according to the color of toner particles contained in the toner cartridge to be used.

In the electrophotographic copying apparatus in accordance with the present invention, a voltage-adjusting device adjusts a bias voltage generated between the developing sleeve and the toner supply roller depending on a toner color, whereby a predetermined picture image density can be ensured irrespective of the toner color.

In other words, the density of the picture image of an original document formed according to the electrophotograpic copying apparatus becomes neither light nor dark each time a toner cartridge is exchanged to develop the picture image of the original document in a different color.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
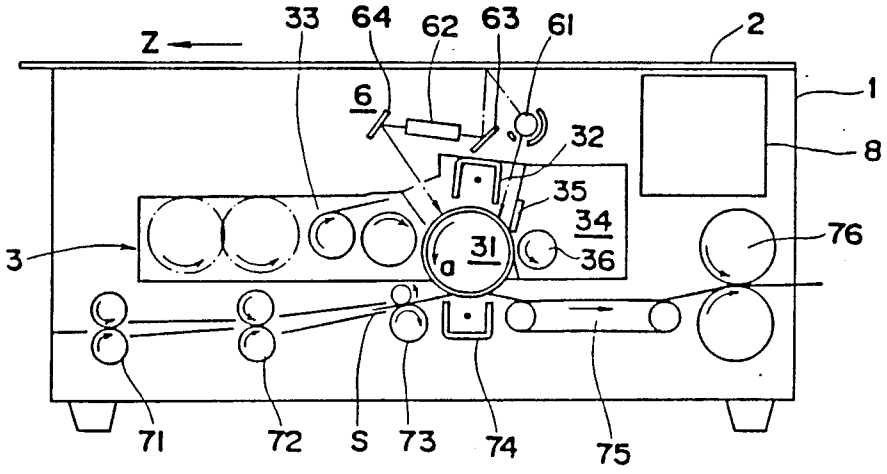
FIG. 1 is a schematic side elevation view of an electrophotographic copying apparatus according to one preferred embodiment of the present invention.

Before the description of the present invention proceeds, it is to be noted that like parts are designated by like reference numerals through out the several views of the accompanying drawings.

Construction and Operation of Electrophotographic Copying Apparatus

Referring to FIG. 1, there is shown an electrophotographic copying apparatus according to the preferred embodiment of the present invention. The construction thereof is described in conjunction with a copying operation.

When a photoreceptor drum 31 disposed in substantially the middle of the electrophotographic copying apparatus (hereinafter referred to as main body 1) is rotating in the direction shown by an arrow (a), the surface of the photoreceptor drum 31 is uniformly charged by the electric discharge of a charger 32.

An original document-placing glass 2 on which an original document (not shown) is placed is scanned in the direction shown by an arrow (Z) by a light irradiated from a light source 61 of an optical system 6. The light reflected from the original document is incident on the photoreceptor drum 31 charged by the charger 32 through mirrors 63, 64 and a SELFOC lens array 62. Thus, an electrostatic latent image corresponding to the image of the original document is formed on the surface of the photoreceptor drum 31. The electrostatic latent image is developed at a developing region (X) by a developer transported by the rotation of a developing sleeve 43 shown in FIG. 2. Thus, a toner image corresponding to the image of the original document is formed.

A copy sheet (S) supplied from a sheet supply tray (not shown) is transported in front of a pair of timing rollers 73 through a pair of drums 71 and a pair of drums 72. Thereafter, the timing roller 73 feeds the copy sheet (S) to the portion where the photoreceptor drum 31 confronts an image transforming charger 74, so that the arrival of the copy sheet (S) at the portion is synchronous with the arrival of the photoreceptor drum 31 at the portion. Thus, the toner image is transferred to the copy sheet (S) by the electric discharge of the image transforming charger 74.

The copy sheet (S) is separated from the surface of the photoreceptor drum 31 by a means (not shown). Thereafter, the copy sheet (S) is transported between a pair of pressure rollers 76 by a transport belt 75 so that the toner image formed on the copy sheet (S) is melted and fixed thereto. Thereafter, the copy sheet (S) is discharged from the main body 1 to a sheet discharge tray (not shown).

A toner which has remained on the surface of the photoreceptor drum 31 is scraped by the blade 35 of a cleaning unit 34. Thereafter, the photoreceptor drum 31 is irradiated by the light source 61. As a result, the residual electric charge thereon is erased to perform subsequent developments. The toner scraped by the blade 35 is collected by a toner collecting roller 36.

An image forming unit 3 comprising the photoreceptor drum 31, charger 32, and a developing device 33 is removably mounted on the main body 1.

Construction of Developing Device

Figure 2:
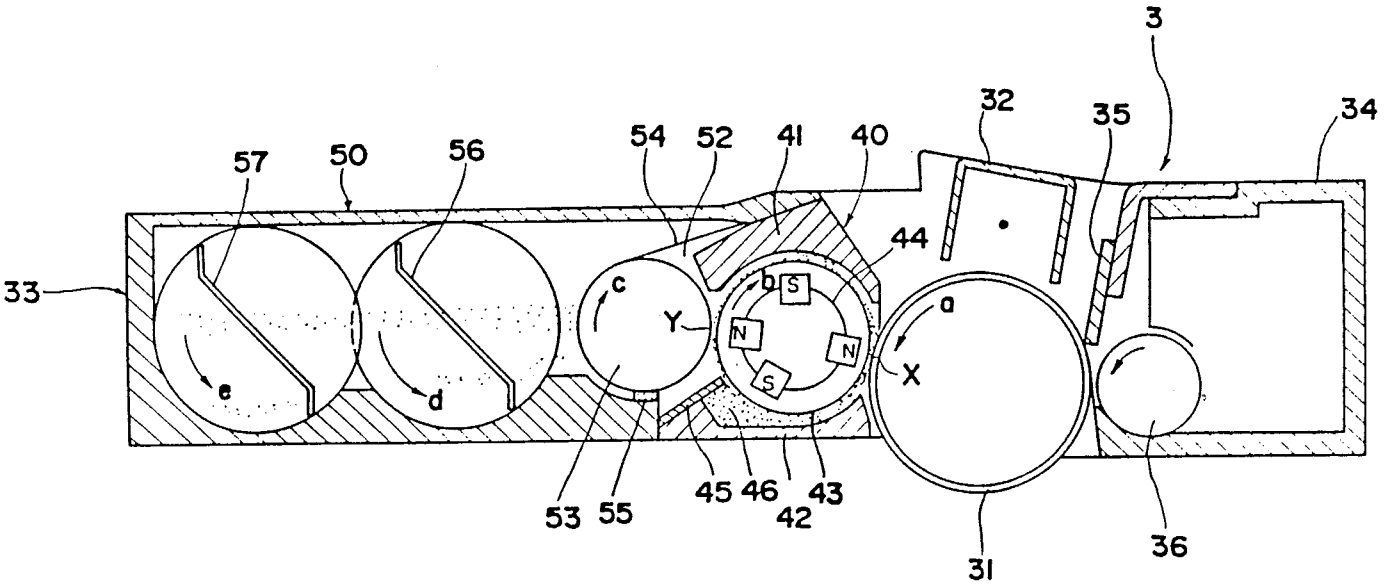
FIG. 2 is a sectional view of the image forming unit shown in FIG. 1.

The developing device 33 is described hereinafter with reference to FIGS. 2 through 4.

Figure 3:
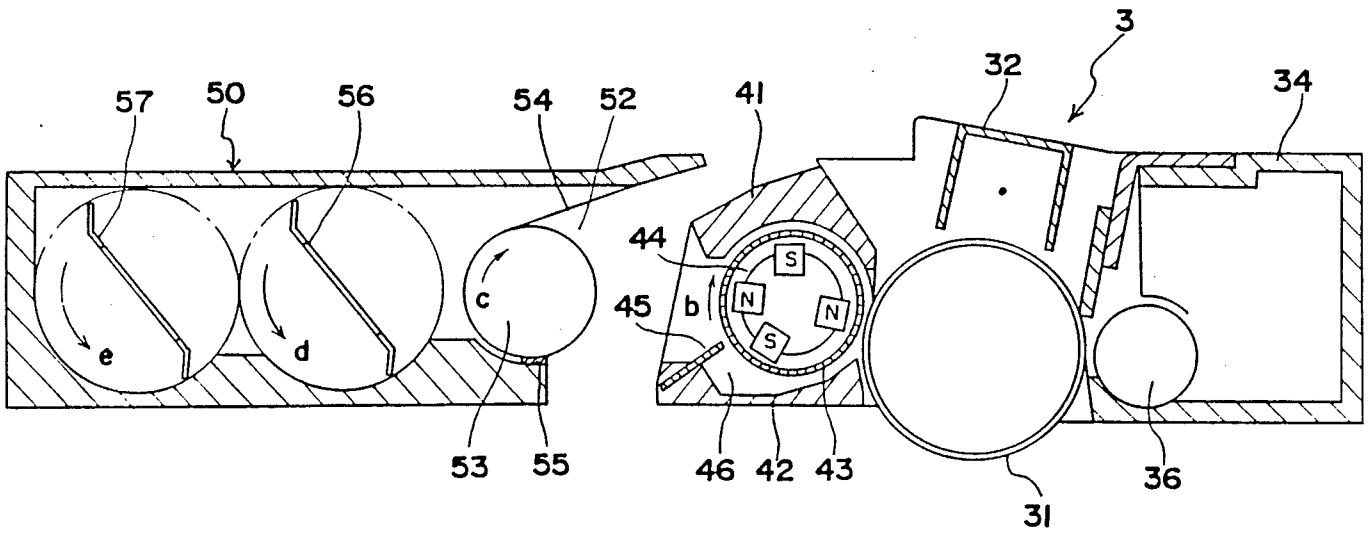
FIGS. 3 and 4 are explanatory drawings showing the split states of the image forming unit shown in FIG. 2.

The developing device 33 removably mounted on the image forming unit 3 comprises a developing unit 40 and a toner cartridge 50 removable from the developing unit 40 as shown in FIG. 3. The toner cartridge 50 is exchangeable for another toner cartridge containing toner particles in a different color. As shown in FIGS. 3 and 4, the image forming unit 3 can be separated in either way as shown in FIGS. 3 and 4.

The developing sleeve 43 is provided in the developing portion 40 comprising an upper frame 41, a lower frame 42, and a side frame (not shown) and is rotatable in the direction shown by an arrow (b). Furthermore, a predetermined developing gap is provided between the developing sleeve 43 and the photoreceptor drum 31. As shown in FIGS. 2 through 4, a magnet roller 44 which is located inside the developing sleeve 43 is fixed to the developing sleeve 43 through which the magnet roller 44 extends. A plurality of magnets whose positive poles N and negative poles S alternate with each other are mounted on the outer surface of the magnet roller 44 in the axial direction thereof. A stationary regulating plate 45 is mounted on the left end face of the lower frame 42 provided below the developing sleeve 43. The top end of the stationary regulating plate 45 confronts the developing sleeve 43 with a certain gap provided therebetween. A developer-collecting portion 46 is formed on the right side of the stationary regulating plate 45.

Figure 4:
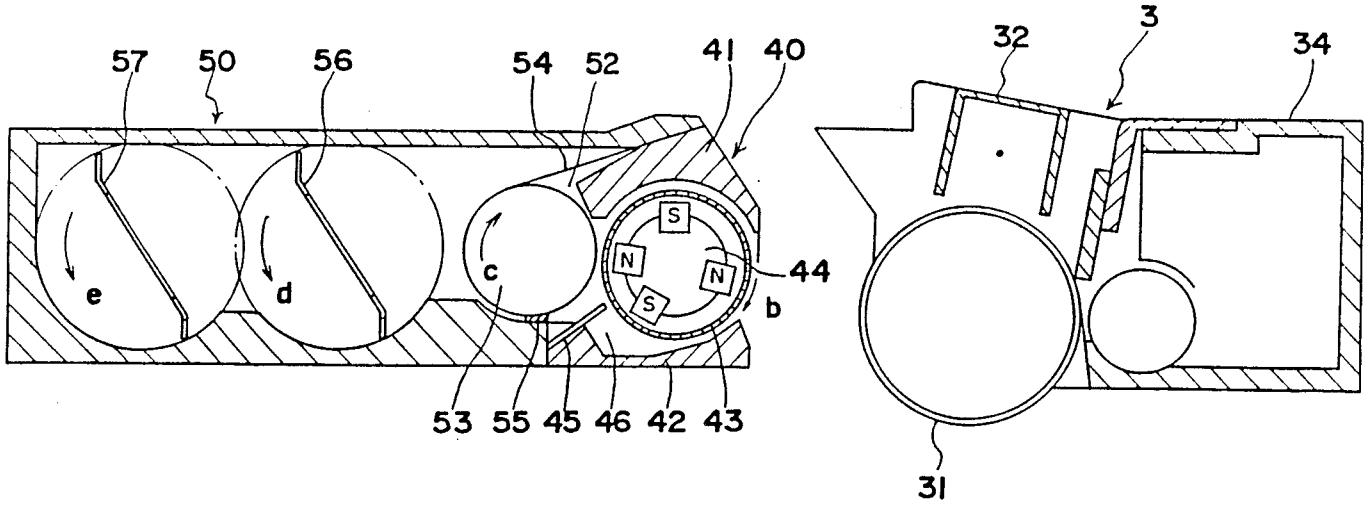

As shown in FIGS. 3 and 4, a toner supply roller 53 is located in the opening portion 52 of the toner cartridge 50 and is rotatable in the direction shown by an arrow (c) and confronts the developing sleeve 43 with a predetermined gap provided therebetween. A blade 54 composed of a non-magnetic material mounted on the upper portion of the opening portion 52 and a non-magnetic toner spill-preventing member 55 mounted on the lower portion of the opening portion 52 are kept in contact under pressure with the upper and lower outer surfaces of the toner supply roller 53, respectively. Thus, there is no space left in the opening 52. Slight irregularities are formed on the outer surface of the toner supply roller 53 by a blasting or an etching. Toner transporting blades 56 and 57 are mounted rearwards from the toner supply roller 53 in parallel with each other and rotate in the direction shown by arrows (d) and (e).

Toner particles are contained inside the toner cartridge 50. Carriers are held on the outer surface of the developing sleeve 43 and in the developer-collecting portion 46. The toner particles are positively charged and the carriers are negatively charged as a result of frictional contacts thereof.

When the image forming unit 3 combined with the developing device 33 is mounted on the main body 1, the developing sleeve 43, the toner supply roller 53, and the toner transporting blades 56 and 57 are connected to a main motor 8 through a driving system (not shown). At this time, a predetermined voltage is applied to the charge wire of the charger 32, and the photoreceptor drum 31 and the cleaning unit 34 are also connected to the main motor 8.

Power Source Supply Means

Figure 5:
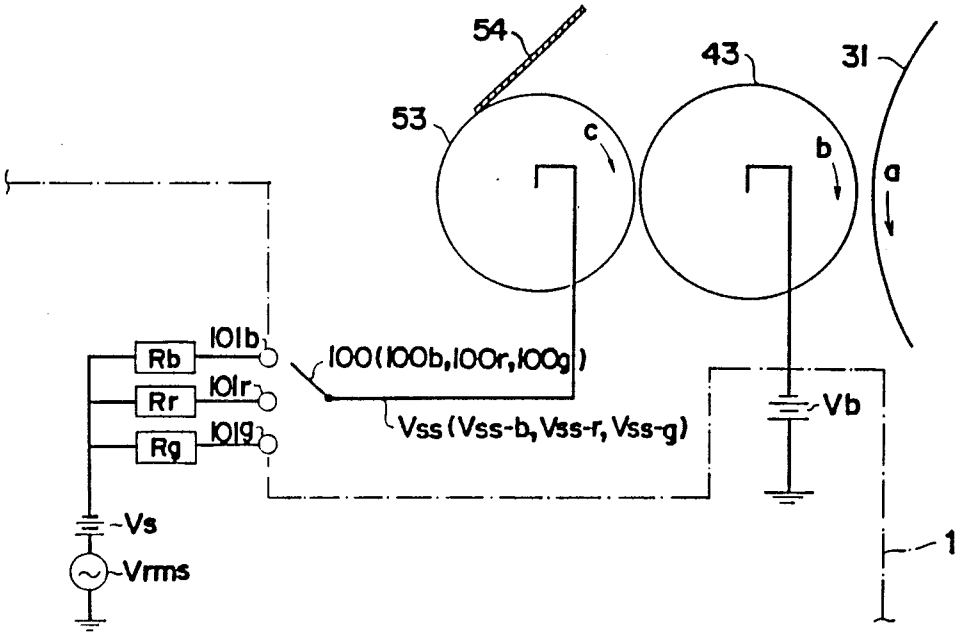
FIG. 5 is a circuit diagram of a power source means of the embodiment according to the present invention.

A means for supplying the power source to the toner supply roller 53 and the developing sleeve 43 of the developing device 33 are described hereinafter with reference to FIG. 5.

A power source terminal (not shown) is attached to the developing unit 40. The power source terminal is connected to the developing-bias power source (developing bias voltage: Vb) of the main body 1 by mounting the image forming unit 3 thereon.

A power source terminal 100 is mounted on the toner cartridge 50. The power source terminal 100 is connected to one of three contacts attached to the main body 1 depending on a toner cartridge, namely, a color of contained toner particles. The contacts **101*b*, 101*r*, and 101*g* mounted on the main body 1 are connected to a toner collecting-bias (hereinafter referred to as collecting-bias) power source through resistors (Rb), (Rr), and (Rg), respectively. The collecting-bias power source is formed by connecting alternating current (Vrms) with direct current (Vs) in series. When the developing device 33** equipped with the toner cartridge 50 and the image forming unit 3 combined with the developing device 33 are mounted on the main body 1, the power source terminal 100 of the toner cartridge 50 is connected to the contact 101 as follows: The power source terminal 100*b* of the toner cartridge 50 containing black toner particles is connected to the contact 101*b*. In this case, a collecting-bias voltage (Vss-b) is applied to the toner supply roller 53. The power source terminal 100*r* of the toner cartridge 50 containing red toner particles is connected to the contact 101*r*. In this case, a collecting-bias voltage (Vss-r) is applied to the toner supply roller 53. The power source terminal 100*g* of the toner cartridge 50 containing green toner particles is connected to the contact 101*g*. In this case, a collecting-bias voltage (Vss-g) is applied to the toner supply roller 53. The collecting-bias voltages (Vss-b), (Vss-r), and (Vss-g) are all different.

The resistance values of the resistors (Rb), (Rr), and (Rg) are set to form the image of an original document in a predetermined density on the copy sheet (S) depending on a cartridge. Therefore, the density of the picture image of the original document developed in black, red, or green by the developing device 33 with the toner cartridge 50 included in the developing device 33 is as predetermined.

Figure 6:
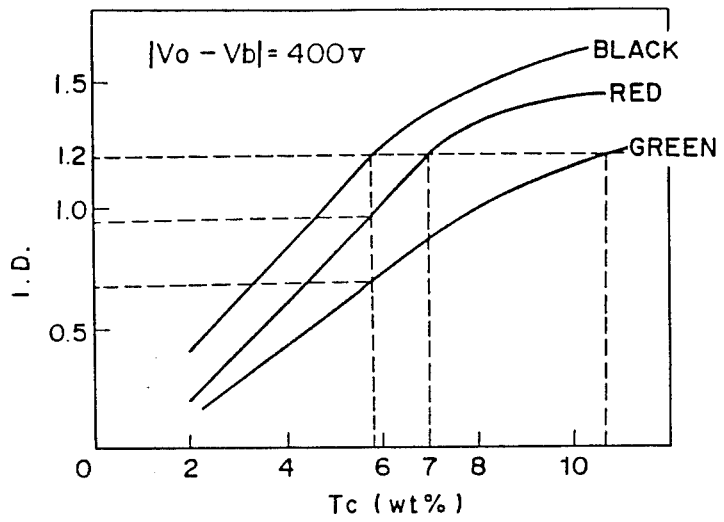
FIG. 6 is a diagram showing the relationship between a toner density and a picture image density of the embodiment according to the present invention.

Specifically, as shown in FIG. 6, in order to develop the picture image of the copy sheet (S) in the density (I.D) of 1.2 when the surface electric potential (V0) of an electrostatic latent image formed on the surface of the photoreceptor drum 31 is −600 V and the developing-bias voltage (Vb) of the developing sleeve 43 is −200 V, the toner densities (Tc) necessary for the black toner particles, red toner particles, and green toner particles are 5.8 wt%, 7.0 wt %, an 10.8 wt %, respectively.

Figure 7:
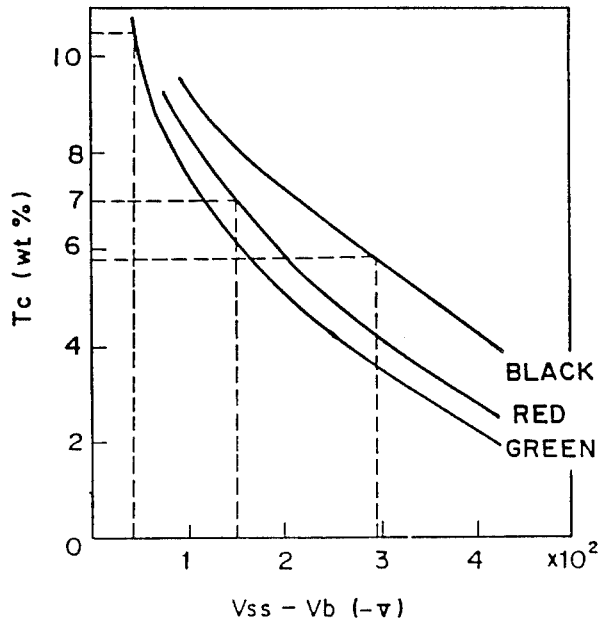
FIG. 7 is a diagram showing the relationship between a difference of a bias voltage between a developing sleeve and a toner supply roller, and a toner density of an embodiment according to the present invention.

As apparent from FIG. 7 showing the bias voltage difference (Vss-Vb) in negative voltage units (−V), namely, the difference, between the collecting-bias voltage (Vss) and the developing-bias voltage (Vb) of the developing sleeve 43, necessary for allowing toner particles in black, red, and green on the developing sleeve 43 to have the above-described densities, the resistance values of the respective resistors (Rb), (Rr), and (Rg) are set so that the collecting-bias voltages (Vss) to be applied to the toner supply roller 53 have the following values:

Black toner . . . $Vss-b=-490$ V
Red toner . . . $Vss-r=-350$ V
Green toner . . . $Vss-g=-240$ V

Operation of Developing Device

The operation of the developing device 33 having the above-described construction is described hereinafter with reference to FIG. 2.

When a copying operation starts, the developing sleeve 43, the toner supply roller 53, the toner transporting blades 56 and 57 rotate in the directions shown by the arrows (b), (c), (d), and (e).

The toner particles contained in the toner cartridge 50 are transported toward the toner supply roller 53 by the rotations of the toner transporting blades 56 and 57 and taken into shallow concaves formed on the outer surface of the toner supply roller 53.

The toner particles held on the surface of the toner supply roller 53 are transported in the direction shown by the arrow (c) by the rotation thereof. An extra amount of toner particles are scraped by the blade 54 kept in contact under pressure with the toner supply roller 53. The remaining toner particles are charged by the blade 54, and then, transported toward a toner supply region (Y) in one layer or two layers.

The carriers are held in the form of a magnetic brush on the outer surface of the developing sleeve 43 along the line of the magnetic force generated by the magnet of the magnet roller 44. The toner particles which have arrived at the toner supply region (Y) where the developing sleeve 43 confronts the toner supply roller 53 are attracted by the magnetic brush-shaped carrier.

The toner supply roller 53 is connected to the power source formed by superposing the alternating current (Vrms) on the direct current (Vss) through one of the resistors (Rb), (Rr) or (Rg) depending on a toner cartridge, namely, a toner color and a predetermined collecting-bias voltage (Vss) is applied to the toner supply roller 53. Accordingly, an oscillation electric field is generated in the toner particles supply region (Y), which oscillates the toners and the carriers. As a result, they are brought into contact with each other in a high frequency. Thus, the toner particles are efficiently supplied to the outer surface of the developing sleeve 43. In addition to the above, in the toner supply region (Y), not only the operation of supplying the toner particles from the toner supply roller 53 to the outer surface of the developing sleeve 43, but also the operation of collecting extra amounts of toner supplied to the developing sleeve 43 onto the toner supply roller 53 are effected according to the voltage difference between the developing-bias voltage (Vb) and the collecting-bias voltage (Vss), whereby the toner density on the developing sleeve 43 is appropriately maintained.

When the toner particles attracted by the carriers are transported in the direction shown by the arrow (b) by the rotation of the developing sleeve 43, the toner particles are mixed with the carriers to form a two-component developer having an improved electric potential for developing an electrostatic latent image. Thus, the developer is electrostatically supplied to the developing region (X) so as to develop an electrostatic latent image formed on the outer surface of the photoreceptor drum 31.

The developer which has passed through the developing region (X) is transported in the direction shown by the arrow (b) toward the stationary regulating plate 45, which scrapes most of the developer.

The scraped developer is mixed with carriers stored in the developer collecting portion 46. Some of the developer is attracted by the magnetic force of the magnet roller 44 and held on the surface of the developing sleeve 43. Thereafter, it passes through the gap between the developing sleeve 43 and the stationary regulating plate 45. Thus, it is transported to the toner supply region (Y).

The toner density on the developing sleeve 43 is reduced in the developing region (X), but toner particles are mixed with each other and kneaded in the developer collecting portion 46. As a result, the density of the toner becomes uniform. Thereafter, toner particles transported by the toner transporting blades 56 and 57 are added to the toner at the toner supply region (Y). Thus, a uniform developer layer is formed on the surface of the developing sleeve 43 when it is in the toner supply region (Y).

The toner collected onto the surface of the toner supply roller 53 is collected in the toner cartridge 50 by the rotation of the toner supply roller 53.

Exchange of Developing Device

The operation of exchanging the developing device 33 is described hereinbelow.

Assuming that a toner cartridge containing a black toner is mounted on the developing device 33, the power source terminal 100*b* of the toner cartridge is connected to the contact 101*b* of the main body 1 and the collecting-bias voltage (Vss-b) is applied to the toner supply roller 53 through the resistor (Rb).

When the developing device 33 is taken out of the main body 1 and a developing device 33 including a toner cartridge 50 containing a red toner is mounted on the main body 1, the power source terminal 100*r* of the toner cartridge 50 is connected to the contact 101*r* of the main body 1 and the collecting-bias voltage (Vss-r) is applied to the toner supply roller 53.

Thus, the picture image formed in red on the copy sheet (S) has a predetermined density In the above-described embodiment, the developing device 33 is exchanged to develop the picture image of an original document in different colors, but the present invention may also be embodied by exchanging only the toner cartridge 50. In this modification, the value of the direct current (Vs) of the collecting-bias power source (Vss) to be applied to the toner supply roller 53 is varied depending on operations, namely, a toner supply operation, a developing operation, and an operation of collecting toner particles into the toner cartridge 50. A voltage is applied to the toner supply roller 53 by the same power source means so that a predetermined bias voltage difference is generated in the gap between the toner supply roller 53 and the developing sleeve 43.

In the above-described embodiment, the resistors (Rb), (Rr), and (Rg) are mounted on the main body 1 and the power source terminals 100 to be connected to these resistors are mounted on the toner cartridge 50. The power source terminal 100 is connected to a corresponding contact attached to the main body 1 according to a toner cartridge, but the present invention may be accomplished by the following method: The resistors (Rb), (Rr), and (Rg) are mounted on toner cartridges, respectively depending on colors and the developing device 33 and the image forming unit 3 combined therewith is mounted on the main body 1. Thus, a predetermined collecting-bias voltage (Vss) [Vss-b, Vss-r, Vss-g] is applied to the toner supply roller 53.

Figure 8:
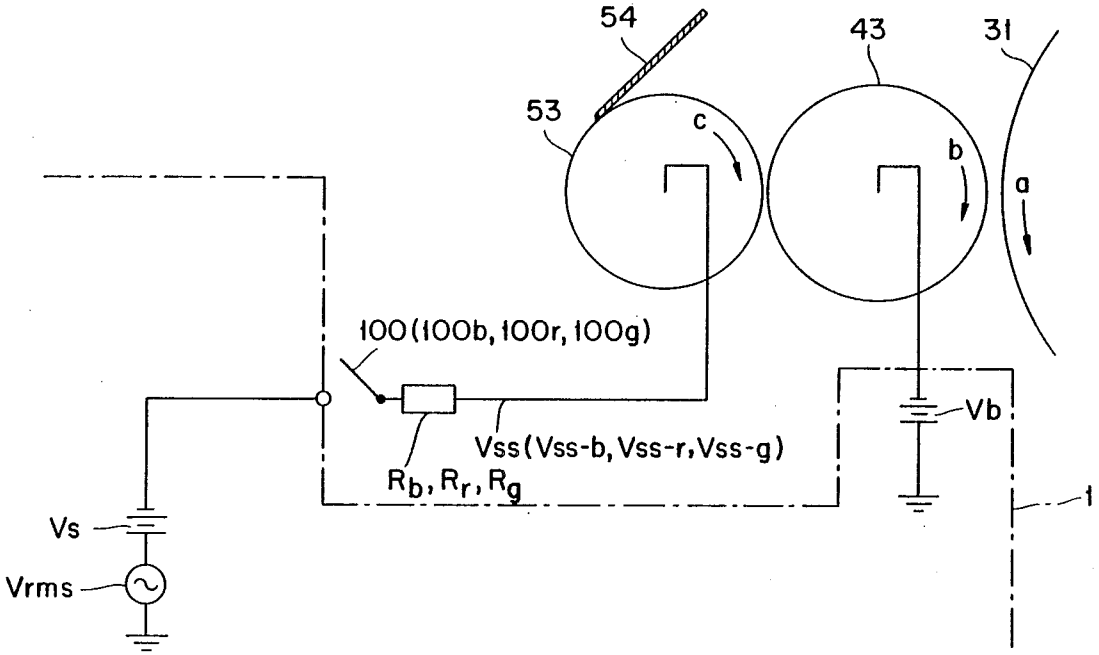
FIG. 8 is a circuit diagram of a power source means of another embodiment according to the present invention.

A following further modification of the present invention may be taken. A pair of connectors is mounted on the image forming unit 3 and the main body 1, respectively so that units included in the image forming unit 3 are electrically connected to the main body 1. A resistor (e.g., Rb, Rr or Rg) is mounted on the toner cartridge 50 and it is mounted on the developing unit 40. Thus, the toner supply roller 53 is electrically connected to the main body 1 through the resistor and the connector as depicted, for example, in FIG. 8.

What is claimed is:

1. An electrophotographic copying apparatus comprising:

a main body;

a developing means, removably mounted on said main body, provided with a developing device having a developing sleeve which holds carriers on the outer surface thereof and a toner cartridge including a toner supply roller which confronts the developing sleeve; and an electric power source means for respectively supplying a predetermined bias voltage to said developing sleeve and said toner supply roller so as to generate different predetermined electric potentials between said developing sleeve and said toner supply roller according to different colors of toner contained in said toner cartridge to be used.

2. The electrophotographic copying apparatus according to claim 1, wherein said bias voltage to be supplied to said roller is generated by a circuit including an AC power source and a DC power source which are connected with each other in series.

3. The electrophotographic copying apparatus according to claim 1, wherein said main body has a plurality of power source terminals for outputting different bias voltages, respectively, and said developing means has a terminal which corresponds, selectively, to one of said power terminals.

4. The electrophotographic copying apparatus according to claim 3, wherein said main body has a bias-power source and a plurality of power source terminals, and a plurality of resistors having different resistance values are provided between said bias-power source and said power source terminals.

5. The electrophotographic copying apparatus according to claim 1, wherein said main body has a plurality of power source terminals which output different bias voltages, and said developing means has a terminal which corresponds, selectively, to one of the power source terminals, and a plurality of resistors having, respectively, predetermined resistance values corresponding to the colors of toner are provided between the respective power source terminals and a power source.

6. The electrophotographic copying apparatus according to claim 1, wherein said toner cartridge is removable from said developing device.

7. The electrophotographic copying apparatus according to claim 1, wherein said toner supply roller supplies toner, but does not supply carriers.

8. The electrophotographic copying apparatus according to claim 1, wherein said main body has a power source terminal which outputs a bias voltage, and said developing means has a terminal which corresponds to the power source terminal, and one of a plurality of resistors having a predetermined resistance value corresponding to the color of toner is provided between the toner supply roller and the power source terminal.

* * * * *